US009937370B2

(12) United States Patent
Kronebusch et al.

(10) Patent No.: US 9,937,370 B2
(45) Date of Patent: Apr. 10, 2018

(54) AUTOMATIC FIRE EXTINGUISHER

(71) Applicant: Kronebusch Industries, LLC, Rochester, MN (US)

(72) Inventors: Allen R. Kronebusch, Oronoco, MN (US); Levi Fisher, Narvon, PA (US)

(73) Assignee: Kronebusch Industries, LLC, Rochester, MN (US)

( * ) Notice: Subject to any disclaimer, the term of this patent is extended or adjusted under 35 U.S.C. 154(b) by 33 days.

(21) Appl. No.: 14/444,521

(22) Filed: Jul. 28, 2014

(65) Prior Publication Data

US 2015/0129246 A1 May 14, 2015

Related U.S. Application Data

(60) Provisional application No. 61/900,468, filed on Nov. 6, 2013.

(51) Int. Cl.
*A62C 37/12* (2006.01)
*A62C 13/76* (2006.01)

(52) U.S. Cl.
CPC ..... *A62C 37/12* (2013.01); *A62C 13/76* (2013.01)

(58) Field of Classification Search
CPC ..... A62C 13/76; A62C 37/12
USPC ..... 169/46, 59, 60, 21, 42
See application file for complete search history.

(56) References Cited

U.S. PATENT DOCUMENTS 783,826 A * 2/1905 Dinkel ..... B05B 1/267 169/37
2,519,350 A * 8/1950 Cahusac ..... A62C 35/645 169/26
2,588,788 A * 3/1952 Zell ..... A62C 35/605 169/26
3,448,808 A * 6/1969 Olson ..... A62C 3/006 169/19
3,719,231 A * 3/1973 Haggard ..... A62C 35/10 169/26
3,768,567 A * 10/1973 Weise ..... A62C 35/605 169/26
3,915,236 A * 10/1975 Stichling ..... A62C 35/605 169/26
4,006,780 A 2/1977 Zehr
4,098,343 A 7/1978 Carroll
4,256,181 A * 3/1981 Searcy ..... A62C 37/12 169/65

(Continued)

FOREIGN PATENT DOCUMENTS

KR 10-2010-0059289 6/2010

OTHER PUBLICATIONS

International Search Report and Written Opinion for Application No. PCT/US2014/064130 dated Feb. 16, 2015.

*Primary Examiner* — Jason Boeckmann
*Assistant Examiner* — Steven M Cernoch
(74) *Attorney, Agent, or Firm* — Merchant & Gould P.C.

(57) ABSTRACT

An apparatus for discharging a fire-extinguishing agent includes a detection mechanism and a triggering mechanism. The detection mechanism includes a temperature responsive element configured to detect the presence of a fire. The triggering mechanism is operatively connected to the detection mechanism and adapted to trigger the discharge of the fire-extinguishing agent from an agent container upon the detection of the presence of a fire by the detection mechanism.

20 Claims, 10 Drawing Sheets

(56) References Cited

U.S. PATENT DOCUMENTS

| | | | | |
|---|---|---|---|---|
| 4,813,487 | A * | 3/1989 | Mikulec | F24C 15/2021 169/26 |
| 4,872,513 | A | 10/1989 | Gardner et al. | |
| 5,247,998 | A * | 9/1993 | Fallon | A62C 4/04 110/193 |
| 5,771,977 | A | 6/1998 | Schmidt | |
| 6,341,655 | B1 * | 1/2002 | Busian | A62C 2/04 169/19 |
| 7,137,455 | B2 * | 11/2006 | Green | A62C 31/02 169/37 |
| 7,303,024 | B2 * | 12/2007 | Mikulec | A62C 37/38 169/59 |
| 7,854,269 | B2 * | 12/2010 | Franson | A62C 37/08 169/37 |
| 8,789,615 | B2 * | 7/2014 | Franson | A62C 37/08 169/21 |
| 9,174,078 | B2 * | 11/2015 | Fischer | A62C 37/08 |
| 2002/0056763 | A1 * | 5/2002 | Winebrenner | A62C 31/02 169/37 |

* cited by examiner

AUTOMATIC FIRE EXTINGUISHER

CROSS-REFERENCE TO RELATED APPLICATIONS

This application claims priority to U.S. Ser. No. 61/900,468 filed on Nov. 6, 2013 and titled AUTOMATIC FIRE EXTINGUISHER, which is hereby incorporated by reference in its entirety.

BACKGROUND

Fire extinguishers are sometimes used to extinguish or control small fires in emergency situations. A fire extinguisher typically includes a cylindrical pressure vessel containing an agent in a pressurized state. The agent can be discharged from the vessel and into the fire to extinguish the fire.

Fire extinguishers are often handheld devices that include a manual discharge trigger. Operation of the fire extinguisher involves removing a safety pin and squeezing a handle while aiming a nozzle of the fire extinguisher toward the fire. The agent is then discharged through the nozzle and into the fire.

SUMMARY

In general terms, this disclosure is directed to a fire extinguisher. In one possible configuration and by non-limiting example, this disclosure relates to an automatic fire extinguisher. Various aspects are described in this disclosure, which include, but are not limited to, the following aspects.

One aspect is an apparatus for discharging a fire-extinguishing agent from a fire extinguisher, the fire extinguisher including an agent container storing the fire-extinguishing agent, the apparatus comprising: a detection mechanism including a temperature responsive element configured to detect the presence of a fire; a supporting mechanism configured to support the temperature responsive element; and a triggering mechanism operatively connected to the detection mechanism by the supporting mechanism and adapted to trigger the discharge of the fire-extinguishing agent from the agent container of the fire extinguisher upon the detection of the presence of a fire by the detection mechanism.

Another aspect is an apparatus for discharging a fire-extinguishing agent, the apparatus comprising: an agent container storing the fire-extinguishing agent therein; a detection mechanism positioned remote from the agent container, the detection mechanism configured to detect the presence of a fire; and a dispensing mechanism configured to dispense the fire-extinguishing agent from the agent container when the detection mechanism detects the presence of a fire.

A further aspect is a method for discharging a fire-extinguishing agent from a fire extinguisher, the method comprising: mounting an actuator of the fire extinguisher, the actuator configured to be in fluid communication with an agent source of the fire extinguisher when the actuator is pressed down; installing a housing to the fire extinguisher so that the actuator is accommodated in the housing; supporting a second end of a release clip to the housing while a first end of the release clip protrudes from a front portion of the housing; connecting a pivot portion of the lever to the housing so as to pivot about the pivot point with respect to the housing while a tip portion of the lever protrudes from the front portion of the housing through a longitudinal opening of the housing and is movable along the longitudinal opening; accommodating one of two apertures of a temperature responsive element into the first end of the release clip while accommodating the other aperture of the temperature responsive element into the tip portion of the lever, and arranging an extension element between a resisting portion of the lever and a top portion of the housing so that the extension element is held in a compressed position when the two apertures of the temperature responsive element are accommodated by the first end of the release clip and the tip portion of the lever, wherein the temperature responsive element breaks apart between the two apertures at or above a predetermined temperature; and wherein the extension element is released and extended against the top portion of the housing, pressing down the resisting portion of the lever, and permits the lever to pivot about the pivot portion of the lever with respect to the housing, when the temperature responsive element breaks apart between the two apertures, so that the actuation portion of the lever presses on the actuator of the fire extinguisher.

DETAILED DESCRIPTION

Figure 1:
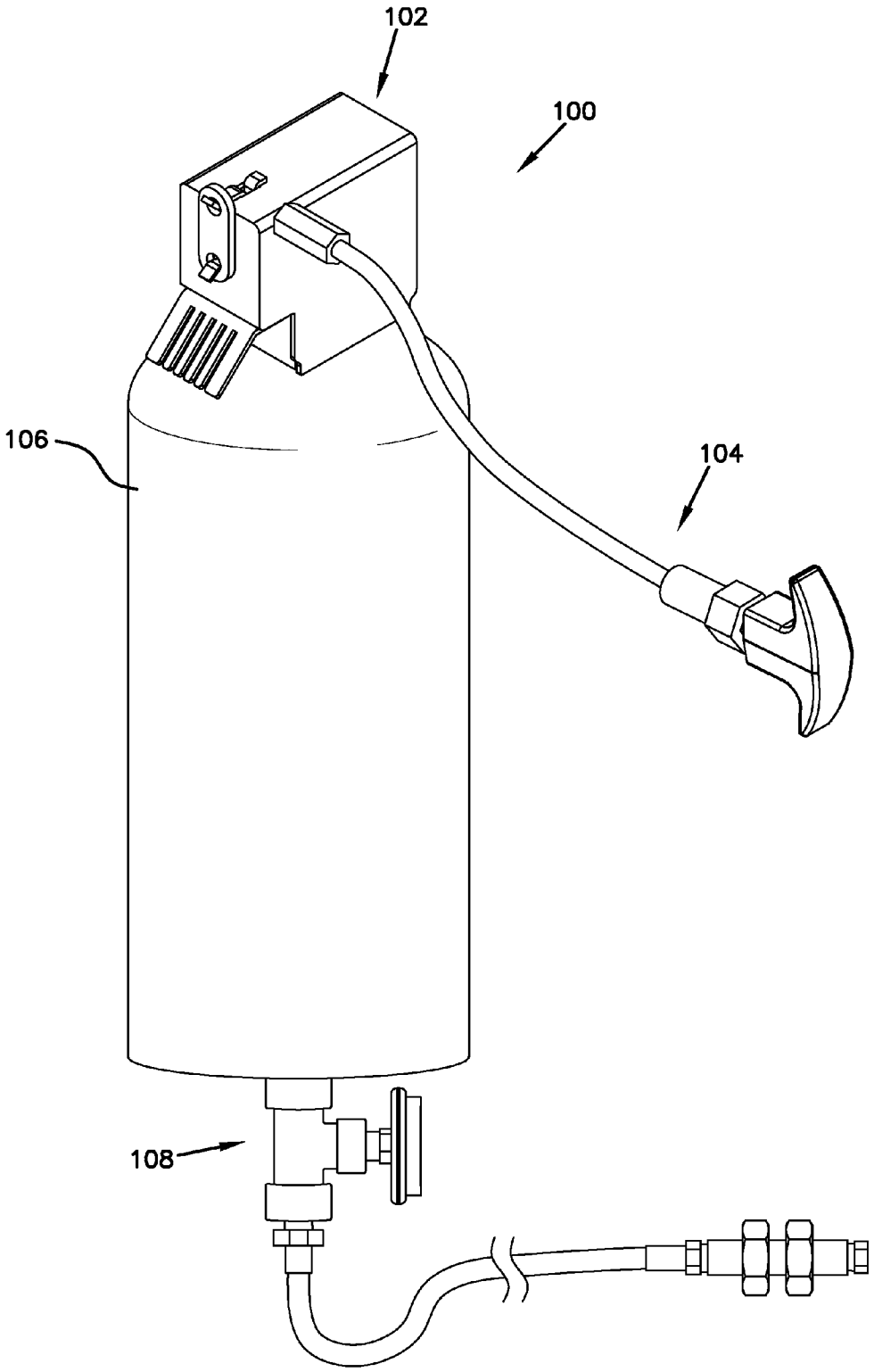
FIG. 1 is a perspective view of an example of a fire extinguisher having automatic discharging assemblies according to the principles of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 is a perspective view of an example of a fire extinguisher 100 having automatic discharging assemblies. In this example the fire extinguisher 100 includes an automatic head assembly 102 with a manual release device 104, an agent container 106, and a remote automatic head assembly 108. Although this example illustrates a fire extinguisher 100 including both the automatic head assembly 102 and the remote automatic head assembly 108, some embodiments include only one of these assemblies, as discussed in further detail below.

In some embodiments the automatic head assembly 102 operates to automatically detect the presence of a fire and to dispense a fire-extinguishing agent from the agent container 106 in response. Some embodiments include a manual release device 104 that can be used to manually trigger the dispensing of the fire-extinguishing agent from the agent container 106. Examples of the automatic head assembly 102 are illustrated and described in more detail with reference to FIGS. 2-8.

The agent container 106 is a container configured to store the fire-extinguishing agent. In some embodiments the agent container 106 stores the fire-extinguishing agent in a pressurized state. A variety of different extinguishing agents can be used, such as a powder-based agent, water, wet chemical and clean agents. For example, different agents are used for different classes of fires, such as fires on ordinary combustibles including wood, cloth, paper and plastics, fires on flammable liquids including gasoline, oil, grease and tar, or fires on energized electrical equipment including wiring, fuse boxes, circuit breakers and machinery. These and other agents can be used in various possible embodiments.

In other possible embodiments the agent container 106 contains an agent useable for a purpose other than for extinguishing a fire. As one example, the agent is a repellant agent that can be used to repel humans or animals. An example of a repellant agent is a lychrymatory agent, such as pepper spray. A repellant agent can be used for policing, riot control, crowd control, and personal self-defense, for example. In some embodiments the device 100 is an agent dispensing device for dispensing fire extinguishing agent or other agents.

In some embodiments the agent container 106 is an aerosol spray can. The aerosol spray can includes a top that is crimped about its edges to form a permanent seal that prevents the agent from leaking from the agent container 106. The construction of the container 106 prevents leaking and allows the fire extinguisher 100 to last for a very long time without requiring frequent servicing, unlike traditional fire extinguishers that typically require annual servicing and have limited shelf lives.

In some embodiments the remote automatic head assembly 108 operates to detect the presence of a fire at a location remote from the rest of the fire extinguisher 100 and to dispense the fire-extinguishing agent in response. Examples of the remote automatic head assembly 108 are illustrated and described in more detail with reference to FIGS. 9-11.

FIGS. 2-7 illustrate examples of the automatic head assembly 102 shown in FIG. 1.

Figure 2:
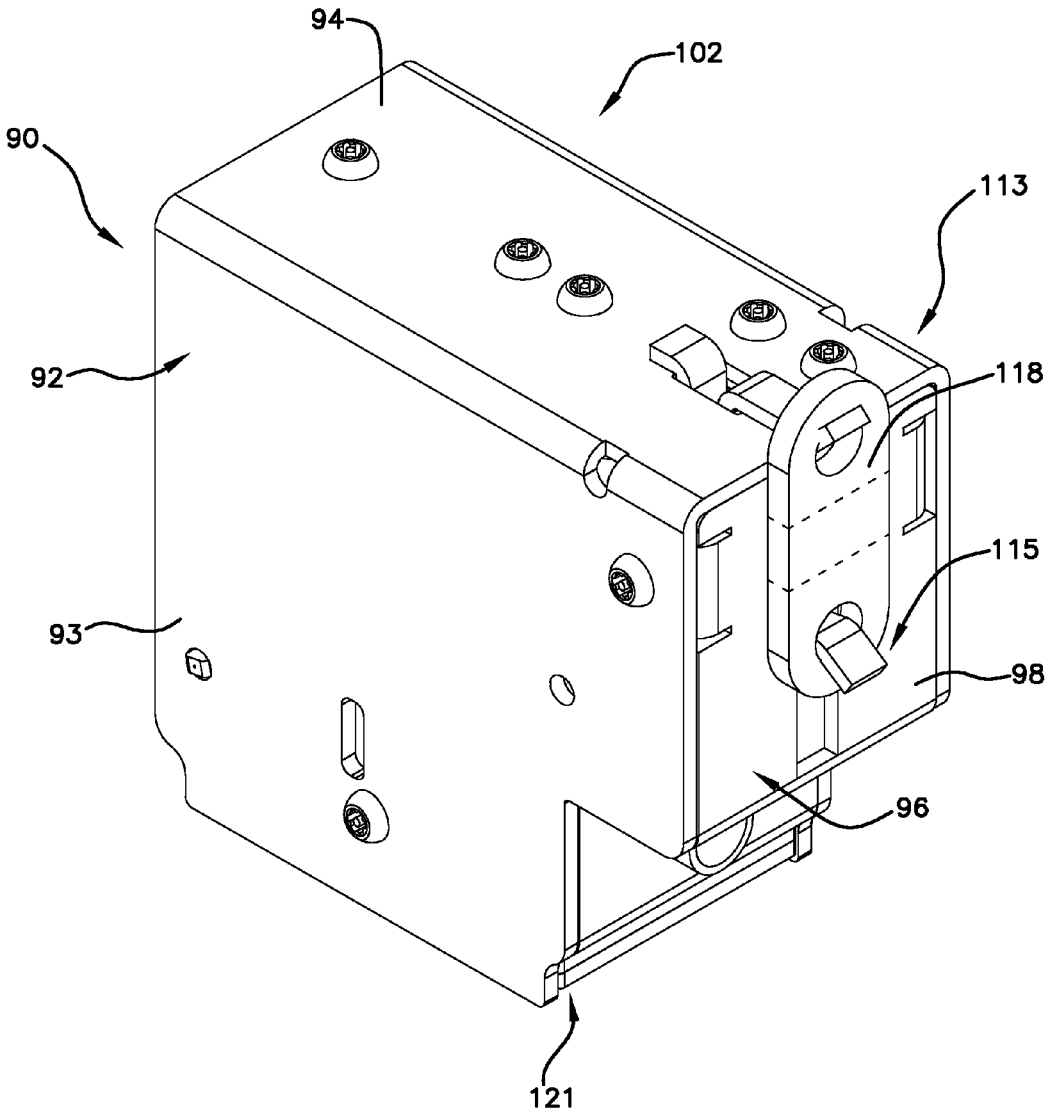
FIG. 2 is a perspective view of the automatic head assembly according to the principles of the present disclosure.

FIG. 2 is a perspective view of an example of the automatic head assembly 102. In this example, the automatic head assembly 102 includes a housing 90, a detection mechanism 113, an installation mechanism 121, and a triggering mechanism 115. The housing is configured to support the detection mechanism 113 thereon and enclose the triggering mechanism 115 therein.

In some embodiments the housing 90 includes a body 92 and a frame 96. The body 92 has a top portion 94 and opposing side portions 93. The body 92 is configured to correspond to the frame 96 so that the body 92 is engaged with the frame 96 and defines an enclosure that can accommodate the triggering mechanism 115 therein as explained below. The frame 96 has a bottom portion 97 (See FIG. 4) and a front portion 98 and is configured to be assembled with the body 92.

The detection mechanism 113 of the automatic head assembly 102 operates to automatically detect the presence of a fire. In this example, the detection mechanism 113 is configured to respond to a predetermined temperature around the automatic head assembly 102. An example of the detection mechanism 113 is illustrated and described in more detail with reference to FIGS. 3 and 4.

The installation mechanism 121 is configured to install the housing 90 to the agent container 106. In this example, the installation mechanism 121 attaches the bottom portion 97 of the frame 96 to the head of the agent container 106 (shown in FIG. 1). An example of the installation mechanism 121 is illustrated and described in more detail with reference to FIGS. 4 and 5.

The triggering mechanism 115 is configured to dispense a fire-extinguishing agent from the agent container 106 in response to the operation of the detection mechanism 113. The triggering mechanism 115 is accommodated in the housing 90. An example of the triggering mechanism 115 is illustrated and described in more detail with reference to FIGS. 4 and 5.

Figure 3:
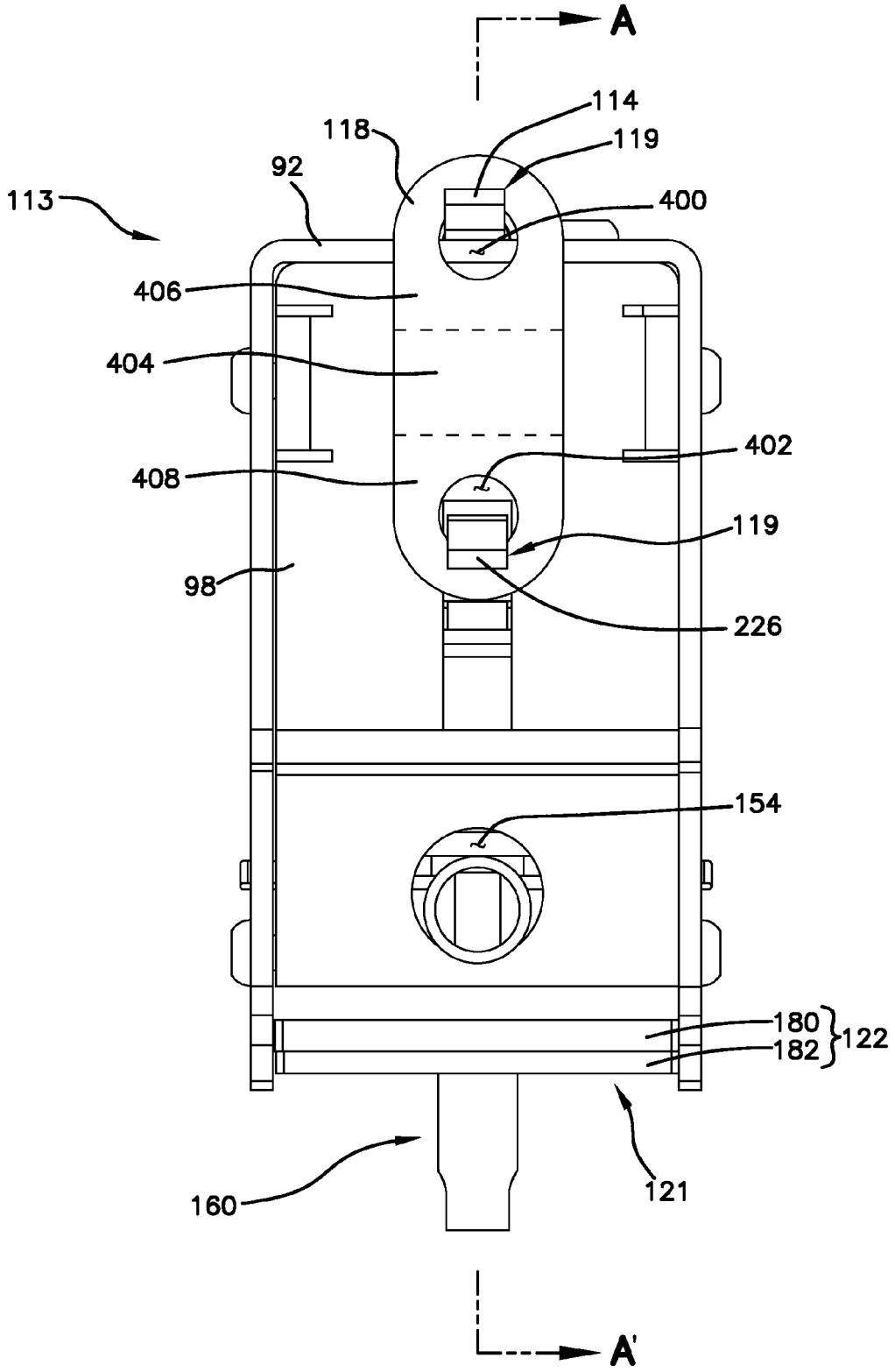
FIG. 3 is a front view of the automatic head assembly shown in FIG. 2.
Figure 4:
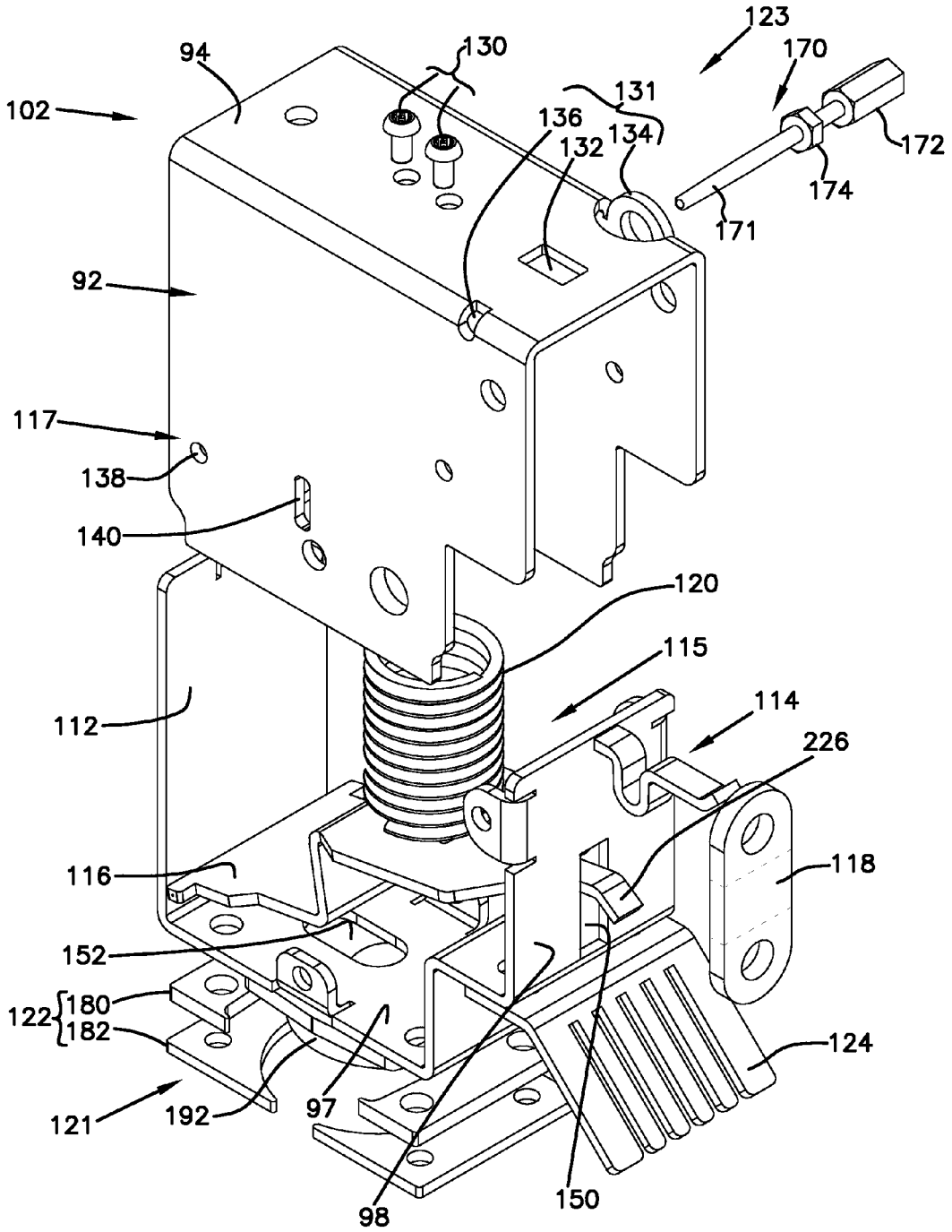
FIG. 4 is an exploded view of the automatic head assembly shown in FIG. 2.
Figure 4:
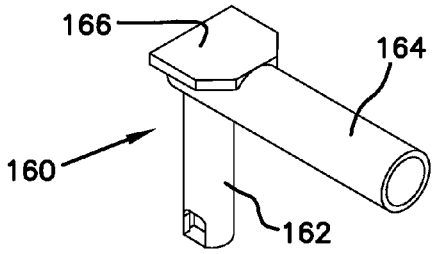
Figure 5:
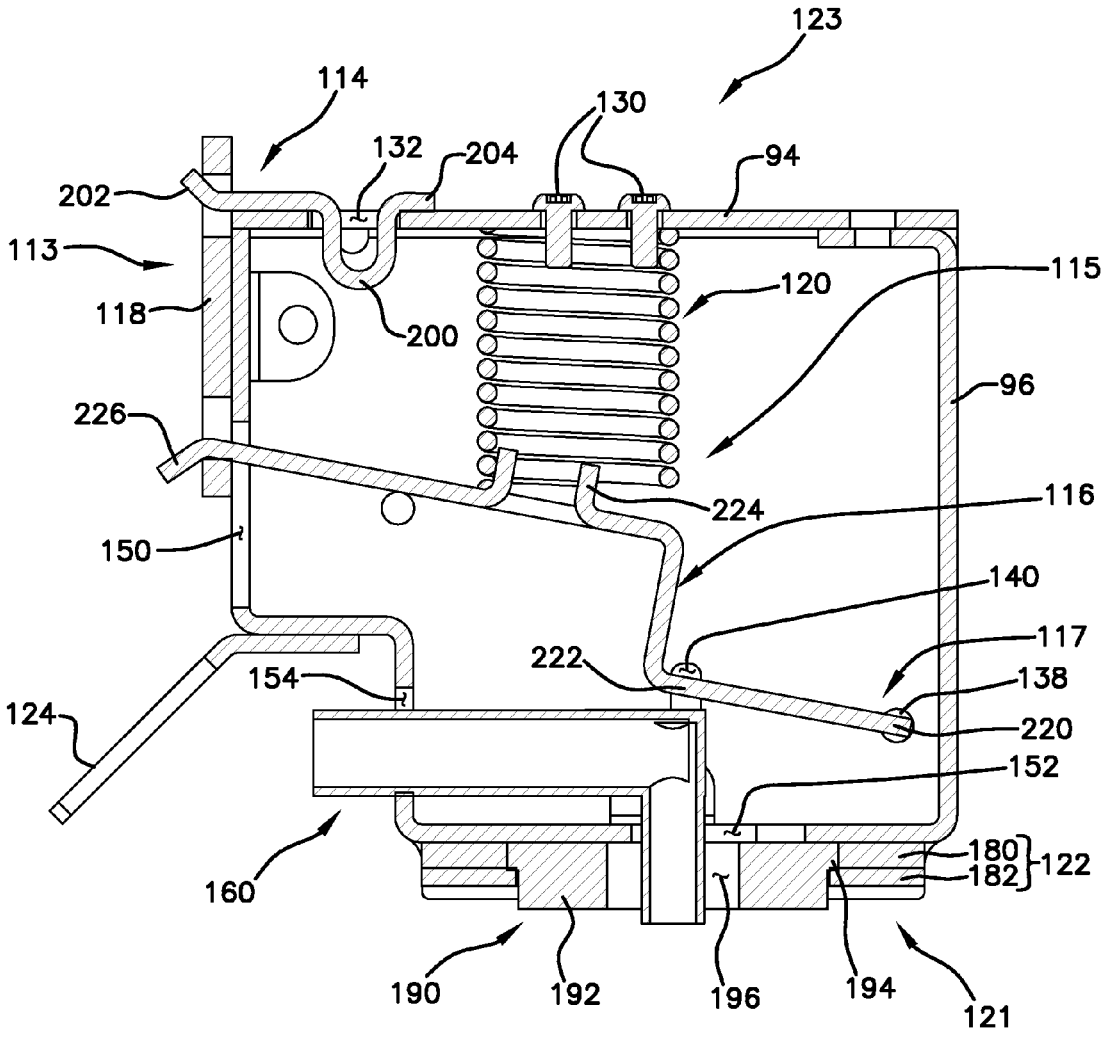
FIG. 5 is a cross-sectional view of the automatic head assembly, taken along section A-A' of FIG. 3.

FIG. 3 is a front view of the automatic head assembly 102. FIG. 4 is an exploded view of the automatic head assembly 102. FIG. 5 is a cross-sectional view of the automatic head assembly 102, taken along section A-A' of FIG. 3.

FIGS. 3 and 4 illustrate an example of the detection mechanism 113 of the automatic head assembly 102. In this example the detection mechanism 113 includes a temperature responsive element 118 and a support mechanism 119.

In some embodiments, the temperature responsive element 118 is configured to detect the presence of a fire by measuring a temperature around the fire extinguisher 100 and operate the triggering mechanism 115 at a predetermined temperature. The temperature responsive element 118 includes two opposing apertures 400 and 402 and is configured to break into two pieces between the two opposing apertures 400 and 402 reach a predetermined temperature. In some embodiments, the temperature responsive element 118 is a mechanical fusible link, which includes two metal pieces 406 and 408 soldered with a fusible alloy 404 that is designed to melt at a predetermined temperature. The two opposing apertures 400 and 402 are formed in each of the two metal pieces 406 and 408 with the fusible alloy 404 therebetween. A variety of fusible links can be used, such as including the two opposing apertures with a fusible alloy therebetween. Suitable fusible links are available from Globe Technologies Corporation in Standish, Mich.

The support mechanism 119 is configured to support the temperature responsive element 118 and engage the temperature responsive element 118 with the triggering mechanism 115 so that the temperature responsive element 118 causes the operation of the triggering mechanism 115 at a predetermined temperature around the fire extinguisher 100.

In this example, the support mechanism 119 includes a release clip 114 and a tip portion 226 of a lever 116 while the lever 116 constitutes part of the triggering mechanism 115. The release clip 114 is configured and arranged to hold one 400 of the two opposing apertures 400 and 402 of the temperature responsive element 118. In this example, the release clip 114 is secured on the top portion 94 of the body 92 and arranged to protrude over a plane that incorporates the front portion 98 of the frame 96. The protruded portion of the release clip 114 is configured to bend upwardly to form a hook-like portion so that the protruded portion can hold an upper aperture 400 of the two apertures of the temperature responsive element 118. In this example, the release clip 114 is secured on the top portion 94 of the body 92 with a clip support 131 and a release pin 170, as explained in detail below, because the release clip 114 is also configured to operate as part of the manual release device 104. However, the release clip 114 can also be configured to operate solely to hold the temperature responsive element 118. In this case, the clip support 131 and the release pin 170 are not required to secure the release clip 114, and the release clip 114 can be attached on the top portion 94 of the body 92 in any manner, provided that the release clip 114 provides a portion that protrudes over the front portion 98 of the frame 96 to hold the upper aperture 400 of the temperature responsive element 118. In other embodiments, the release clip 114 can be integrally made with the housing 90 so as to eliminate any other elements required for securing the release clip 114 to the housing 90.

The tip portion 226 of the lever 116 is configured and arranged to hold the other aperture 402 of the temperature responsive element 118. In this example, the tip portion 226 of the lever 116 is accommodated in, and guided by, a longitudinal opening 150 of the frame 96. Furthermore, the tip portion 226 of the lever 116 is arranged to protrude through the longitudinal opening 150 of the frame 96. In particular, the frame 96 includes the longitudinal opening 150 formed in the front portion 98 of the frame 96. The longitudinal opening 150 is arranged vertically with respect to the bottom portion 97 of the frame 96 and accommodate the tip portion 226 of the lever 116 while the tip portion 226 protrudes from the longitudinal opening 150 of the frame 96. Thus, the longitudinal opening 150 can guide a vertical movement of the tip portion 226 of the lever 116 when the lever 116 pivots with respect to the housing 90 as explained in detail below. In some embodiments, the tip portion 226 is configured to deflect downwardly to form a hook-like portion so that the tip portion 226 can hold the lower aperture 402 of the temperature responsive element 118.

In other embodiments, the tip portion 226 can be configured as an element separate from the lever 116 and then connected to the lever 116 so long as the tip portion can hold the other aperture 402 while being arranged to protrude through the longitudinal opening 150 and move along the longitudinal opening 150.

FIGS. 4 and 5 illustrate an example of the triggering mechanism 115 of the automatic head assembly 102. In this example, the triggering mechanism 115 includes an actuator 160, an actuator support 151, the lever 116, a lever support 117, an extension element 120, and an extension element support 123.

The actuator 160 operates to release a fire-extinguishing agent that has been contained in the agent container 106 in a pressurized state and discharge the agent through the conduit formed in the actuator 160. In this example, the actuator 160 is installed to the agent container 106 and is selectively in fluid communication with the chamber of the agent container 106, in which a fire-extinguishing agent is stored in a pressurized state. In some embodiments, the actuator 160 includes an inlet pipe 162, a discharging pipe 164, and a receptive portion 166. The inlet pipe 162 and the discharging pipe 164 are connected to be in fluid communication. In this example, the discharging pipe 164 is connected to the inlet pipe 162 substantially at a right angle. The inlet pipe 162 of the actuator 160 is mounted to the agent container 106 and can be retractably pressed toward the chamber of the agent container 106. When the actuator 160 is pressed down toward the chamber of the agent container 106, the inlet pipe 162 of the actuator 160 becomes in fluid communication with the chamber so that the agent stored in the chamber in a pressurized state can be discharged through the inlet pipe 162. Specifically, the inlet pipe 162 of the actuator 160 is connected to the agent container 106 but is not in fluid communication with the chamber when the fire extinguisher 100 is not in operation. In contrast, when the receptive portion 166 of the actuator 160 is pressed down over a threshold pressure, the inlet pipe 162 of the actuator 160 is connected to the chamber of the agent container 106, thereby allowing the pressurized agent stored in the chamber to spurt from the chamber and discharge through the inlet pipe 162 and the discharging pipe 164.

The actuator support 151 is configured to accommodate and support the actuator 160 within the housing 90. In this example, the actuator 160 includes a first opening 152 and a second opening 154. The first opening 152 is configured in the bottom portion 97 of the frame 96 to accommodate the inlet pipe 162 of the actuator 160. The second opening 154 is configured in the front portion 98 of the frame 96 to accommodate the discharging pipe 164 of the actuator 160. In particular, the first opening 152 of the frame 96 is configured to allow inserting the discharging pipe 164 and the receptive portion 166 of the actuator 160 when the automatic head assembly 102 is installed to the agent container 106. The second opening 154 of the frame 96 is configured to accommodate the discharging pipe 164 of the actuator 160 and to allow at least the outlet of the discharging pipe 164 to protrude from the frame 96. Therefore, at least part of the inlet pipe 162, the receptive portion 166, and at least part of the discharging pipe 164 of the actuator 160 are supported inside the housing when the automatic head assembly 102 is installed to the agent container 106.

Figure 6:
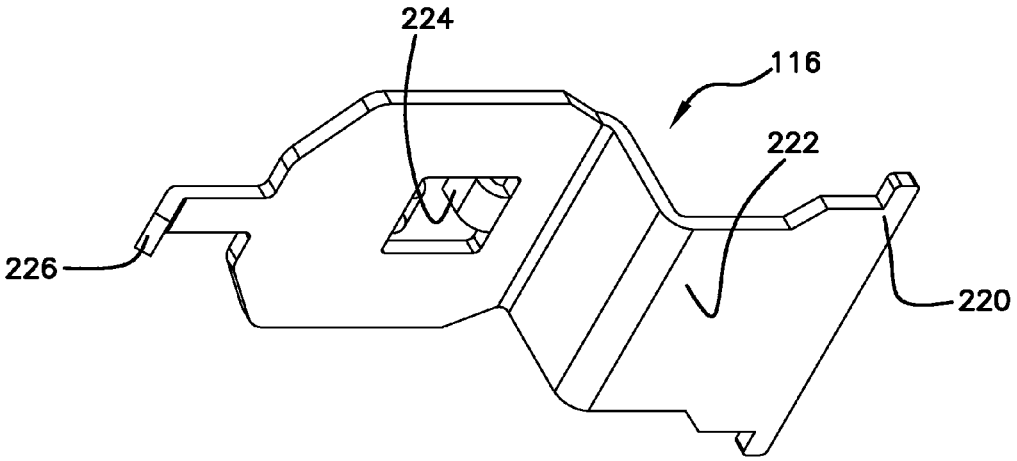
FIG. 6 is a perspective view of an example of the lever according to the principles of the present disclosure.

FIG. 6 is a perspective view of an example of the lever 116 of the present disclosure. The lever 116 is configured to be operated by the extension element 120 when the detection mechanism 113 detects the presence of a fire around the fire extinguisher 100 so that the actuator 160 becomes in fluid communication with the agent container 106 to discharge the agent contained in the agent container 106. In one embodiment, the lever 116 includes the pivot portion 220, an actuation portion 222, a resisting portion 224, and the tip portion 226.

The pivot portion 220 of the lever 116 is configured to be engaged with the lever support 117 and permit the lever 116 to pivot about the pivot portion 220. The pivot portion 220 is provided at the end of the lever 116, which is opposite to the tip portion 226. In this example, the pivot portion 220 includes a pair of opposing projections. As explained again below, the opposing projections of the pivot portion 220 are engaged with pivot support apertures 138 of the lever support 117.

The resisting portion 224 of the lever 116 operates as the extension element support 123, along with the top portion 94 of the body 92, to support the extension element 120 within the housing 90. The resisting portion 224 is illustrated in further detail below.

The actuation portion 222 of the lever 116 is configured and arranged adjacent to the receptive portion 166 of the actuator 160 so that the actuation portion 222 presses down the actuator 160 on the receptive portion 166 when the triggering mechanism 115 operates by the detection mechanism 113. In some embodiments, the actuation portion 222 is arranged to locate above the receptive portion 166 of the actuator 160 when the extension element 120 is in a compressed state between the resisting portion 224 of the lever 116 and the top portion 94 of the body 92, as illustrated in detail below. The operation of the actuation portion 222 of the lever 116 is described in further detail below.

As explained with respect to the detection mechanism 113, the tip portion 226 of the lever 116 is configured to hold the lower aperture 402 of the temperature responsive element 118 while the release clip 114 holds the upper aperture 400 of the temperature responsive element 118. In this example, it is preferable that the tip portion 226 has a hook-like portion that bent downwardly so that the tip portion 226 can hold the lower aperture 402 of the temperature responsive element 118.

Turning again to FIGS. 4 and 5, the lever support 117 is provided to support the lever 116 within the housing 90 and to permit the lever 116 to operate in response to the detection of a fire by the detection mechanism 113. In this example, the lever support 117 includes the pivot support apertures 138 of the body 92 and the longitudinal opening 150 of the frame 96.

In this example, the pivot support apertures 138 are configured to rotatably support the lever 116 at the pivot portion 220 of the lever 116. For this configuration, the opposing projections of the pivot portion 220 are engaged with the pivot support apertures 138. In some embodiments, the pivot support apertures 138 can be arranged on the side portions 93 of the body 92 so that the lever 116 can pivot about the pivot support apertures 138 with respect to the housing 90.

As explained above, the longitudinal opening 150 of the frame 96 is configured and arranged to support the tip portion 226 of the lever 116 so that the tip portion 226 can support the lower aperture 402 of the temperature responsive element 118. For this configuration, the tip portion 226 of the lever 116 is arranged in the housing 90 to protrude through the longitudinal opening 150 of the frame 96. In this structure, the tip portion 226 of the lever 116 can move along the longitudinal opening 150 as the lever 116 pivots about the pivot support apertures 138. Therefore, the lever 116 can swing around the pivot support apertures 183 of the body 92 while the movement of a tip portion 226 of the lever 116 is restricted along a longitudinal opening 150 of the frame 96.

In this example, the extension element 120 is configured, along with the extension element support 123, to provide the triggering mechanism 115 with operational force. In some embodiments, the extension element 120 can include a compression coil spring, as illustrated in FIGS. 4 and 5. However, the extension element 120 can be any element that can store mechanical energy with a compression load, or any other mechanism that can exert pressure on the lever 116 of the triggering mechanism 115 when the detection mechanism 113 operates in response to the presence of a fire.

The extension element support 123 is configured to support the extension element 120 within the housing 90 and permits the extension element 120 to operate the triggering mechanism 115 in response to the detection mechanism 113. In some embodiments, the extension element support 123 includes a support device 130 of the body 92 and the resisting portion 224 of the lever 116 so that the extension element 120 is arranged between the support device 130 and the resisting portion 224.

The support device 130 of the body 92 is arranged on the top portion 94 of the body 92 and is configured to support one end of the extension element 120 against the top portion 94 of the body 92 within the housing 90. In some embodiments, the support device 130 includes a pair of bolts that are fastened on the top portion 94 of the body 92 so that they protrude from the top portion 94 of the body 92 to the inside of the housing 90. The projected portions of the bolts support the end of the extension element 120 against the top portion 94 of the body 92 and confine a possible displacement or misalignment of the extension element 120 when the extension element 120 is in a compressed state as illustrated in FIG. 5.

The resisting portion 224 is configured to support the other end of the extension element 120 within the housing 90 so that the extension element 120 is arranged in place between the lever 116 and the top portion 94 of the body 92 when the extension element 120 is in a compressed state. In some embodiments, the resisting portion 224 can include one or more projections that extend toward the other end of the extension element 120, as also illustrated in FIG. 6, so that the projections support the other end of the extension element 120. In another embodiment, the resisting portion 224 can be modified to have any structure, depending on a particular configuration of the extension element 120, provided that it supports the other end of the extension element 120.

As such, one end of the extension element 120 is supported by the support device 130 of the body 92 while the other end is supported by the resisting portion 224 of the lever 116, so that the extension element 120 is arranged between the top portion 94 of the body 92 and the lever 116. In other embodiments, the extension element support 123 can be modified in various ways, depending on the structures of the extension element 120 or other relevant components of the automatic head assembly 102.

With the configurations discussed above, the triggering mechanism 115 operates to discharge a fire-extinguishing agent from the agent container 106 in response to the detection mechanism 113. In some embodiments, the triggering mechanism 115 is configured and arranged to have the extension element 120 is held in a compressed state between the resisting portion 224 of the lever 116 and the top portion 94 (in particular, the support device 130) of the body 92 when the support mechanism 119 of the detection mechanism 113 supports the temperature responsive element 118 in place. In particular, when the two apertures 400 and 402 of the temperature responsive element 118 are supported by the tip portion 226 of the lever 116 and the end of the release clip 114, respectively, the temperature responsive element 118 holds the extension element 120 in a compressed state where the extension element 120 exerts extension force on the resisting portion 224 of the lever 116 against the top portion 94 of the body 92.

When the temperature responsive element 118 breaks apart between the two opposing apertures at or above a predetermined temperature, the compression of the extension element 120 is released. Therefore, the extension element 120 can extend against the top portion 94 of the body 92 and exert pressure on the lever 116 at the resisting portion 224 of the lever 116. The lever 116 can thus pivot about the pivot portion 220 of the lever 116 with respect to the housing and allow the tip portion 226 of the lever 116 to move down along the longitudinal opening 150 in the frame 96. The downward pressure by the extension element 120 pushes down the actuation portion 222 of the lever 116, and, subsequently, the actuation portion 222 presses down the receptive portion 166 of the actuator 160. As the actuator 160 is pressed downwardly, the inlet pipe 162 of the actuator 160 becomes in fluid communication with the chamber of the agent container 106, thereby allowing the agent that is stored in the chamber in a pressurized state to flow from the chamber and discharge through the inlet pipe 162 and the discharging pipe 164 of the actuator 160.

FIGS. 4 and 5 further illustrate an example of the installation mechanism 121 of the automatic head assembly 102. The installation mechanism 121 is configured and arranged to install the automatic head assembly 102 onto the agent container 106 as the housing 90 of the automatic head assembly 102 accommodates an actuator 160 of the agent container 106. In this example, the installation mechanism 121 includes a collet 190 and a mounting assembly 122.

The collet 190 is configured to be fixed to the agent container 106 and operate as a connection to the housing 90 of the automatic head assembly 102. In this example, the collet 190 has a column 192 and a flange 194 formed on the top of the column 192. The column 192 of the collet 190 is fixed to the agent container 106. The collet 190 has an aperture 196 passing through its center so that the inlet pipe 162 of the actuator 160 is inserted through the aperture 196. The collet 190 can preferably be made of plastic to minimize possible leakage of an agent from the container.

In this example, the mounting assembly 122 is used to install the bottom portion 97 of the frame 96 to the agent container 106. In one embodiment, the mounting assembly 122 includes a spacer plate 180 and a support plate 182. The spacer plate 180 is configured to define a space that corresponds to the dimension of the flange 194 of the collet 190. The support plate 182 is configured to define a space that corresponds to the column 192 of the collet 190. When the automatic head assembly 102 is mounted to the agent container 106, the flange 194 of the collet 190 is first placed underneath the bottom portion 97 of the frame 96. The spacer plate 180 is placed around the flange 194 of the collet 190 underneath the bottom portion 97 of the frame 96. Then, the support plate 182 is placed around the column 192 of the collet 190 under the flange 194 and the spacer plate 180 and is coupled to the bottom portion 97 of the frame 96 through the spacer plate 180. In this embodiment, the support plate 182 is fastened to the bottom portion 97 of the frame 96 through the spacer plate 180 by screw bolts. Although FIG. 4 illustrates that the spacer plate 180 and the support plate 182 consist of two pieces, respectively, each of them can be made in a single piece or in more than two pieces, depending on the modification of the automatic head assembly 102.

FIGS. 4 and 5 further illustrate an example of a see-through hole 140 of the automatic head assembly 102. The see-through hole 140 is arranged on the housing 90 so that part of the triggering mechanism 115 is exposed outside the housing 90. In some embodiments, the body 92 can include a see-through hole 140 on either or both of the side portions 93 of the body 92. For example, the see-through hole 140 is preferably located near the receptive portion 166 of the actuator 160 and the actuation portion 222 of the lever 116 for a maintenance purpose. The see-through hole 140 allows looking through the inside of the housing and determining whether the lever 116 (in particular, the actuation portion 222 of the lever 116) is arranged in an appropriate position with respect to the receptive portion 166 of the actuator 160 in the housing. In other embodiments, the see-through hole 140 can also be made to determine the assembling conditions of other elements in the housing.

FIGS. 4 and 5 further illustrate an example of an agent-flow guide 124 that is attached to the automatic head assembly 102. The agent-flow guide 124 is configured and arranged to adjust the direction, and/or forms the shape, of the agent flowing through the inlet pipe 162 and the discharging pipe 164 from the chamber of the agent container 106. In this example, the agent-flow guide 124 is connected to the housing adjacent to the outlet of the discharging pipe 164 of the actuator 160. In other embodiments, the agent-flow guide 124 is in a rake shape with a plurality of slits and is connected to the front portion 98 of the frame 96 above the outlet of the discharging pipe 164 while being apart from the outlet of the discharging pipe 164. In still other embodiments, the agent-flow guide 124 is also bent downwardly in front of the outlet of the discharging pipe 164 so as to at least partially interfere with the agent flow that is discharged from the discharging pipe 164. Therefore, the plurality of slits formed in the agent-flow guide 124 can break the flow of agent and make it easier for the agent to spread out over the scene of fire. Because the agent-flow guide 124 is arranged downwardly, it can also operate to force the flow of agent downward and makes it convenient to aim the spot of fire with the fire extinguisher.

The automatic head assembly 102 has a variety of applications. For example, the fire extinguisher 100 having the automatic head assembly 102 can be installed in engine compartments or other confined areas of machinery such as corn dryers, clothes dryers or diesel engine rooms so as to quickly extinguish an accidental fire without requiring the presence of people. Commercial kitchens or chimneys can be another application of the fire extinguisher of the present disclosure.

Figure 7:
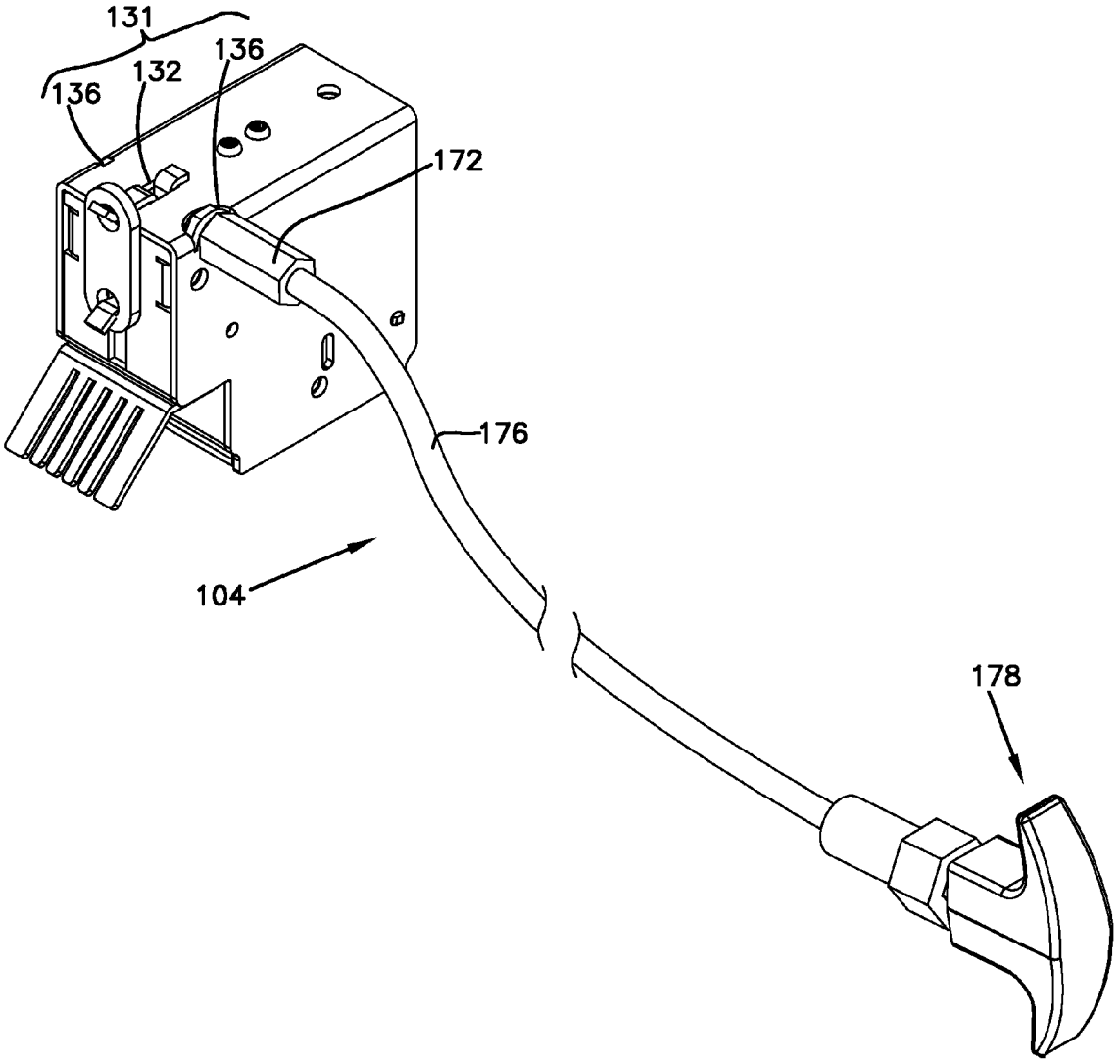
FIG. 7 is a perspective view of an example of the manual release device of the automatic head assembly according to the principles of the present invention.

FIG. 7 is a perspective view of an example of the manual release device 104 of the automatic head assembly 102. The manual release device 104 is used to manually trigger the dispensing of the fire-extinguishing agent from the agent container 106 before the triggering mechanism 115 automatically operates in response to the detection mechanism 113 at a predetermined temperature. In one embodiment, the manual release device 104 includes a release clip 114, a release pin 170, a clip support 131, a cable 176 and a handle 178.

Figure 8:
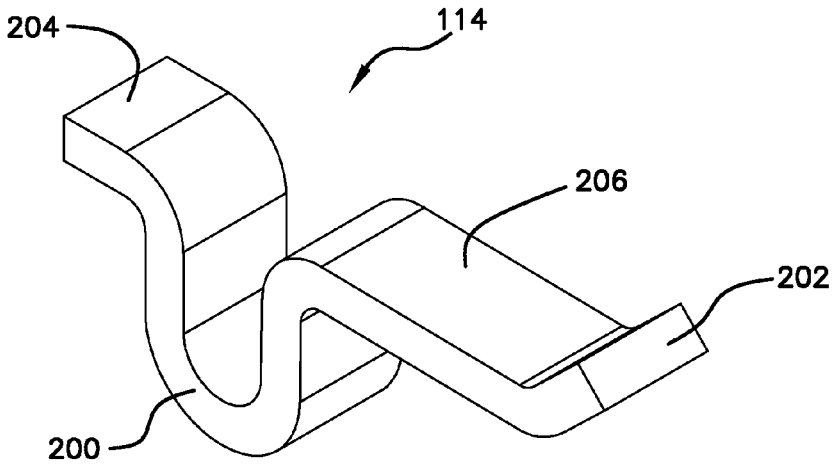
FIG. 8 is a perspective view of an example of the release clip adapted to the manual release device of the automatic head assembly shown in FIG. 7.

FIG. 8 is a perspective view of an example of the release clip 114 that is adapted to the manual release device 104 of the automatic head assembly 102. As explained above with respect to the detection mechanism 113, the release clip 114 basically operates to provide support of the upper aperture 400 of the temperature responsive element 118. In this example, the release clip 114 is further modified to be used for the manual release device 104 as well as for support of the temperature responsive element 118 of the detection mechanism 113. In some embodiments, the release clip 114 has a first end 202, a second end 204, and a curved portion 200 that is formed downwardly between the first end 202 and the second end 204. The curved portion 200 is connected with the first end 202 through a middle portion 206.

In this example, the release pin 170 is provided to support the release clip 114 to the clip support 131, as described in further detail below. In some embodiments, the release pin 170 includes a pin portion 171, a head portion 172 and a securing element 174.

In this example, the clip support 131 is provided on the top portion 94 of the body 92. The clip support 131 is configured to support the release clip 114 on the housing 90 by the release pin 170, as described in further detail below. As illustrated in FIG. 4, the clip support 131 includes a nest aperture 132, a head aperture 134, and a tail aperture 136. The nest aperture 132 is configured to accommodate the curved portion 200 of the release clip 114. The head aperture 134 is configured to fasten the head portion 172 of the release pin 170. The tail aperture 136 is adapted to accommodate the end of the pin portion 171 of the release pin 170.

With these configurations, the release clip 114 is mounted on the top portion 94 of the body 92 and is arranged close to the front portion 98 of the frame 96. In particular, the curved portion 200 of the release clip 114 is inserted into the nest aperture 132 of the body 92 while the second end 204 and a middle portion 206 rest on the surface of the top portion 94 of the body 92. The release clip 114 is then secured on the top portion 94 of the body 92 by the release pin 170. In particular, the pin portion 171 of the release pin 170 is inserted from the head aperture 134 and slides through the head aperture 134. Then, the pin portion 171 of the release pin 170 passes through a hole defined by the nest aperture 132 and the curved portion 200 of the release clip 114. The pin portion 171 of the release pin 170 reaches the tail aperture 136 and fits into the tail aperture 136. As such, the length of the release pin 170 is placed underneath the top portion 94 of the body 92 while passing through the curved portion 200 of the release clip 114, thereby preventing the release clip 114 from being disassembled from the body 92.

In some embodiments, the head aperture 134 can be configured to secure the head portion 172 of the release pin 170 with the securing element 174 of the release pin 170. In this example, the head aperture 134 is configured to have a flat-ring shape, or washer-like shape. Therefore, the securing element 174 of the release pin 170 is fastened to the head portion 172 of the release pin 170 with the head aperture 134 of the body 92 therebetween.

In this example, the head portion 172 and the securing element 174 of the release pin 170 are configured to be fastened with the head aperture 134 therebetween so that the release pin 170 is secured in the top portion 94 of the body 92. In some embodiments, the securing element 174 includes a nut and a corresponding portion threaded on the outer surface of the release pin 170 adjacent to the head portion 172 of the release pin 170. When the release pin 170 is inserted through the head aperture 134 of the body 92, the curved portion 200 of the release clip 114 and the tail aperture 136 of the body 92, the nut of the securing element 174 is fastened to the head portion 172 of the releases pin 170 with the washer-like head aperture 134 of the body 92.

In other embodiments, the threaded portion of the release pin 170 and the securing element 174 can operate not only as a means for fastening the release pin 170 to the top portion 94 of the body 92, as explained above, but as a safety stopper that only permits the release pin 170 to be pulled out by a force over a threshold extension force. Specifically, the threaded portion of the release pin 170 and the corresponding securing element 174 (in this example, a nut) are fastened together with the washer-like head aperture 134 of the body 92 therebetween and the release pin 170 can be loosen from the securing element 174 only when a predetermined tension (or pulling) force is applied to the release pin 170. The predetermined tension force is determined as a force that overcomes the axial clamping force of the fastening between the threaded portion of the release pin 170 and the securing element 174 without screwing the securing element 174 out from the threaded portion of the release pin 170.

As explained above with respect to the support mechanism 119 of the detection mechanism 113, the first end 202 of the release clip 114 is arranged to protrude from the body 92 or the front portion 98 of the frame 96 when the release clip 114 is installed to the top portion 94 of the body 92. In this example, the first end 202 of the release clip 114 is configured to bend upwardly to form a hook-like portion so that the first end 202 can hold the upper aperture 400 of the temperature responsive element 118 when the release clip 114 is mounted in place on the top portion 94 of the body 92. In this example, the release clip 114 is made in one piece. However, the release clip 114 can be assembled with several subparts. The release clip 114 can be made of any material including stainless steel or plastic.

In this example, the manual release device 104 further includes a cable 176 and a handle 178. The cable 176 is connected between the head portion 172 and the handle 178. The handle 178 provides a grip for pulling out the release pin 170 from the top portion 94 of the body 92.

When a user grips the handle 178 and pulls the cable 176 of the manual release device 104 with the predetermined tension force, the release pin 170 slides out from the tail aperture 136 and the head aperture 134 of the body 92. Then, the release clip 114 is no longer secured by the release pin 170 and is released from the constraint of the release pin 170. As a result, the release clip 114 pops out, and the temperature responsive element 118 loses support at one end of the temperature responsive element 118 (in particular, the upper aperture of the temperature responsive element 118 in FIGS. 1-5) that has been held by the first end 202 of the release clip 114. As such, the temperature responsive element 118 is released from restraint by the first end 202 of the release clip 114 and the tip portion 226 of the lever 116. Accordingly, the extension element 120 that has been in a compressed state between the top portion 94 of the body 92 and the resisting portion 224 of the lever 116 forces the lever 116 down as the extension element 120 extends by tension, and permits the actuation portion 222 of the lever 116 to press down the receptive portion 166 of the actuator 160.

The manual release device 104 allows using the fire extinguisher 100 with the automatic head assembly 102 according to the present disclosure as a typical fire extinguisher that is manually operable. Therefore, although the automatic head assembly 102 is not automatically operated before the temperature near the automatic head assembly 102 reaches a predetermined temperature that breaks apart the temperature responsive element 118, the fire extinguisher 100 can be manually operated by the manual release device 104.

Figure 9:
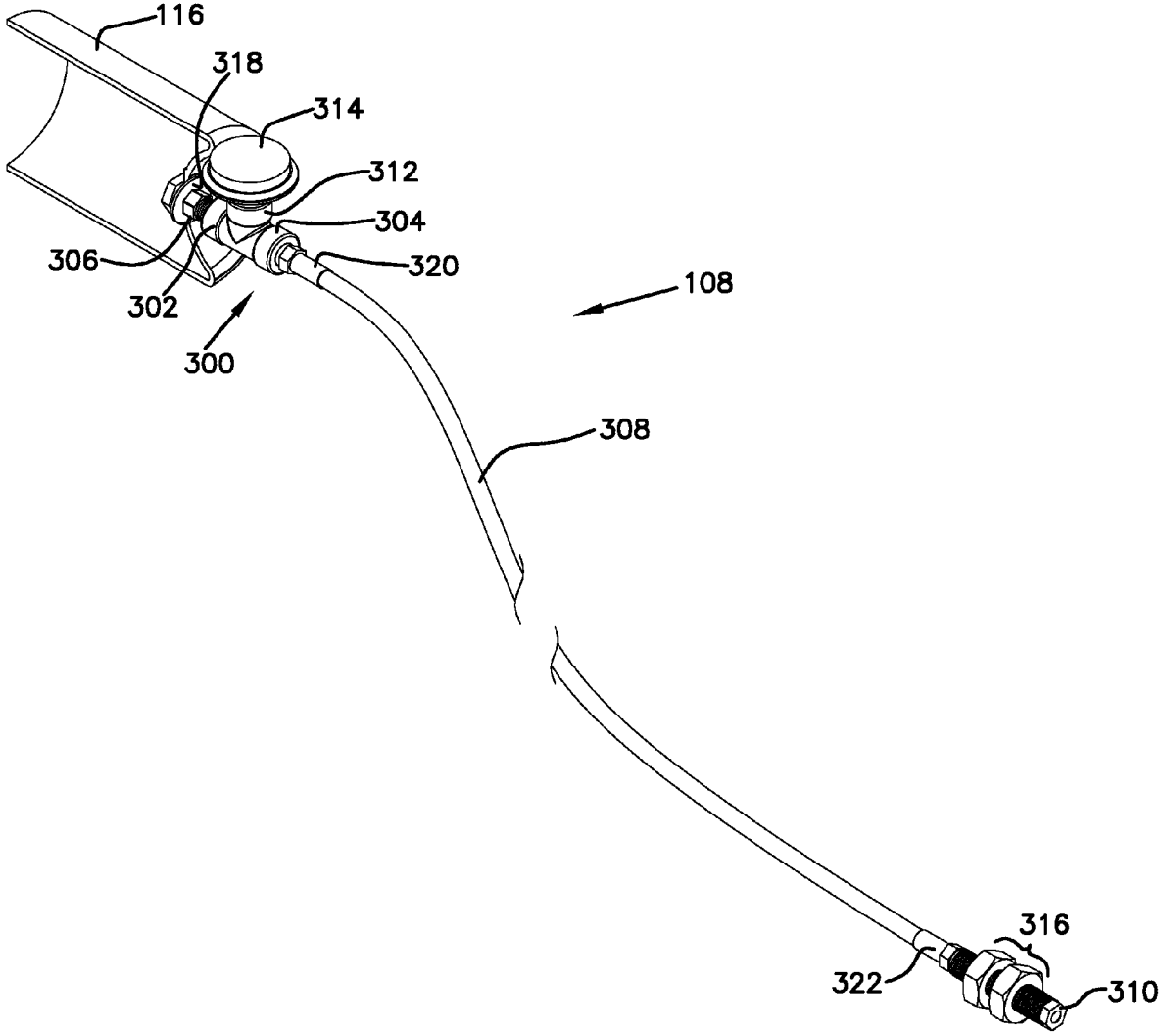
FIG. 9 is a perspective view of another example of a fire extinguisher having a remote automatic head assembly according to the principles of the present disclosure.
Figure 10:
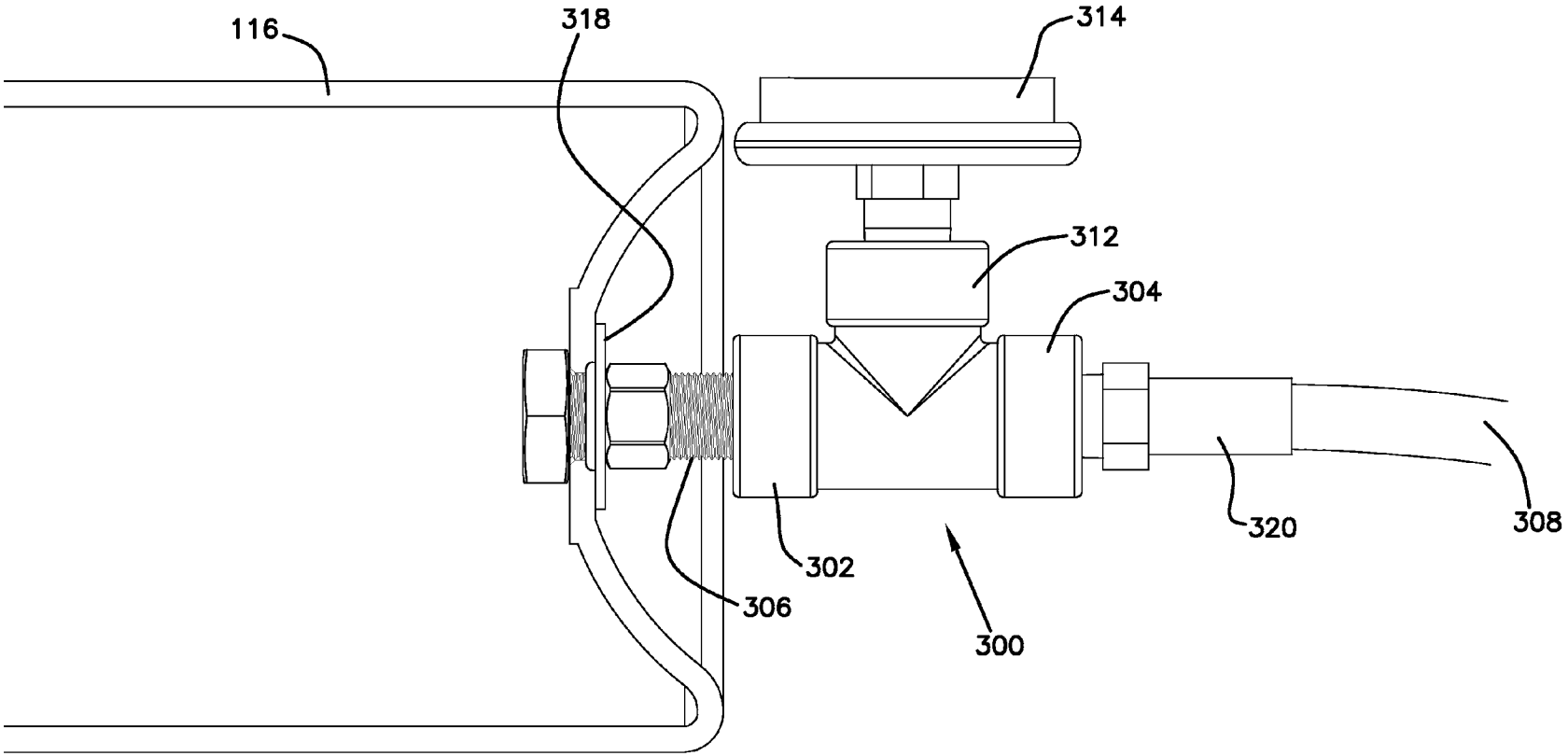
FIG. 10 is a side view of the remote automatic head assembly shown in FIG. 9.

FIGS. 9 and 10 illustrate another embodiment of an automatic discharging assembly for a fire extinguisher according to the present disclosure. The automatic discharging assembly includes the remote automatic head assembly 108. In this example, the remote automatic head assembly 108 is installed to the bottom of the agent container 106 through an outlet hole formed in the bottom of the agent container 106. However, the remote automatic head assembly 108 can be mounted to any portion of the agent container 106. For example, the remote automatic head assembly 108 can be installed on the top of the agent container 106, instead of the automatic head assembly 102. Alternatively, the agent container 106 can be modified to have an outlet hole on any appropriate area on the side of the agent container 106 so that the remote automatic head assembly 108 is connected to the outlet. Furthermore, in some embodiments, the fire extinguisher 100 can include both the automatic head assembly 102 and the remote automatic head assembly 108 while in other embodiments, it can include only one of these assemblies.

In one embodiment, the remote automatic head assembly 108 includes a detection mechanism 309 for detecting the presence of a fire at a location remote from the rest of the fire extinguisher 100 and a dispensing mechanism 299 for dispensing the fire-extinguishing agent in response.

In this example, the detection mechanism 309 can include a temperature responsive element 310. The temperature responsive element 310 is configured to contain the flow of a fire-extinguishing agent from the agent container 106 below a predetermined temperature, and to break apart at or above the predetermined temperature so as to permit the discharge of the agent.

In this example, the dispensing mechanism 299 includes a fitting pipe 300 and a hose 308. The fitting pipe 300 has an inlet port 302 and an outlet port 304. The inlet port 302 is connected to the agent container 106 and is in fluid communication with the chamber of the agent container 106.

In some embodiments, the inlet port 302 is connected to the agent container 106 through a connector 306. The connector 306 is cylindrically shaped and threaded on its outer surface. One end of the connector 306 is connected at the outlet hole of the agent container 106 with two nuts that are screwed in from both ends of the connector 306. One of the nuts is screwed onto the one end of the connector 306 from the inside of the agent container 106, and the other nut is fastened from the outside of the agent container 106 to the other end of the connector 306 along the threaded surface of the connector 306. After one end of the connector 306 is secured at the outlet hole of the agent container 106 with the two nuts, the other end of the connector 306 accommodates the inlet port 302 of the fitting pipe 300 by thread joint. To relieve friction and prevent possible leakage between the connector 306 and the agent container 106, a washer 318 can be inserted along the connector 306 between the outlet hole of the agent container 106 and either of the two nuts.

The outlet port 304 is connected to one end of the hose 308. For example, the one end of the hose 380 can be made with a stainless steel connector 320 that is connected with the outlet port 304 by thread joint. The other end of the hose 380 is arranged at any location where a fire would likely occur. The hose 308 can have various lengths according to the distance between a place where the agent container 106 is installed and a place where the other end of the hose 380 is located.

The other end of the hose 308 is sealed with the temperature responsive element 310 to contain the flow of the agent stored in the agent container 106 before the temperature responsive element 310 reaches a predetermined temperature. For example, the other end of the hose 380 is made with a stainless steel connector 322 that is connected with the temperature responsive element 310 by thread joint. The temperature responsive element 310 breaks and permits the agent to flow out at or above a predetermined temperature.

In some embodiments, the temperature responsive element 310 is a fusible plug with the center hole closed with a fusible alloy, which melts and breaks apart at or above a predetermined temperature. The fusible plug is inserted into the other end of the hose 308 by, for example, thread joint. An example of the fusible plug is Model Number 350165, which is available from Globe Technologies Corporation in Standish, Mich.

In another embodiment, the fitting pipe 300 can further include a gauge port 312. As illustrated in FIGS. 9-10, the gauge port 312 is configured to protrude in a radial direction between the inlet port 302 and the outlet port 304, thereby forming a T-shaped fitting pipe as a whole. The gauge port 312 is in fluid communication with the inlet port 302 and the outlet port 304. The gauge port 312 can accommodate a pressure gauge for measuring the pressure of an agent stored in the chamber of the agent container 106.

The remote automatic head assembly 108 can further include a mounting device 316 to mount the hose 308 at a designated location and direct the other end of the hose 308 to an area where a fire would likely break out. In this example, the mounting device 316 is arranged near the end of the hose 308 and has a connector having a threaded outer surface with two nuts. The two nuts and the threaded portion of the connector are used to mount the end of the hose 308 at a designated location. In another example, the mounting device 316 can be an L-shaped bracket, which attaches the hose 308 on a designated location.

Figure 11:
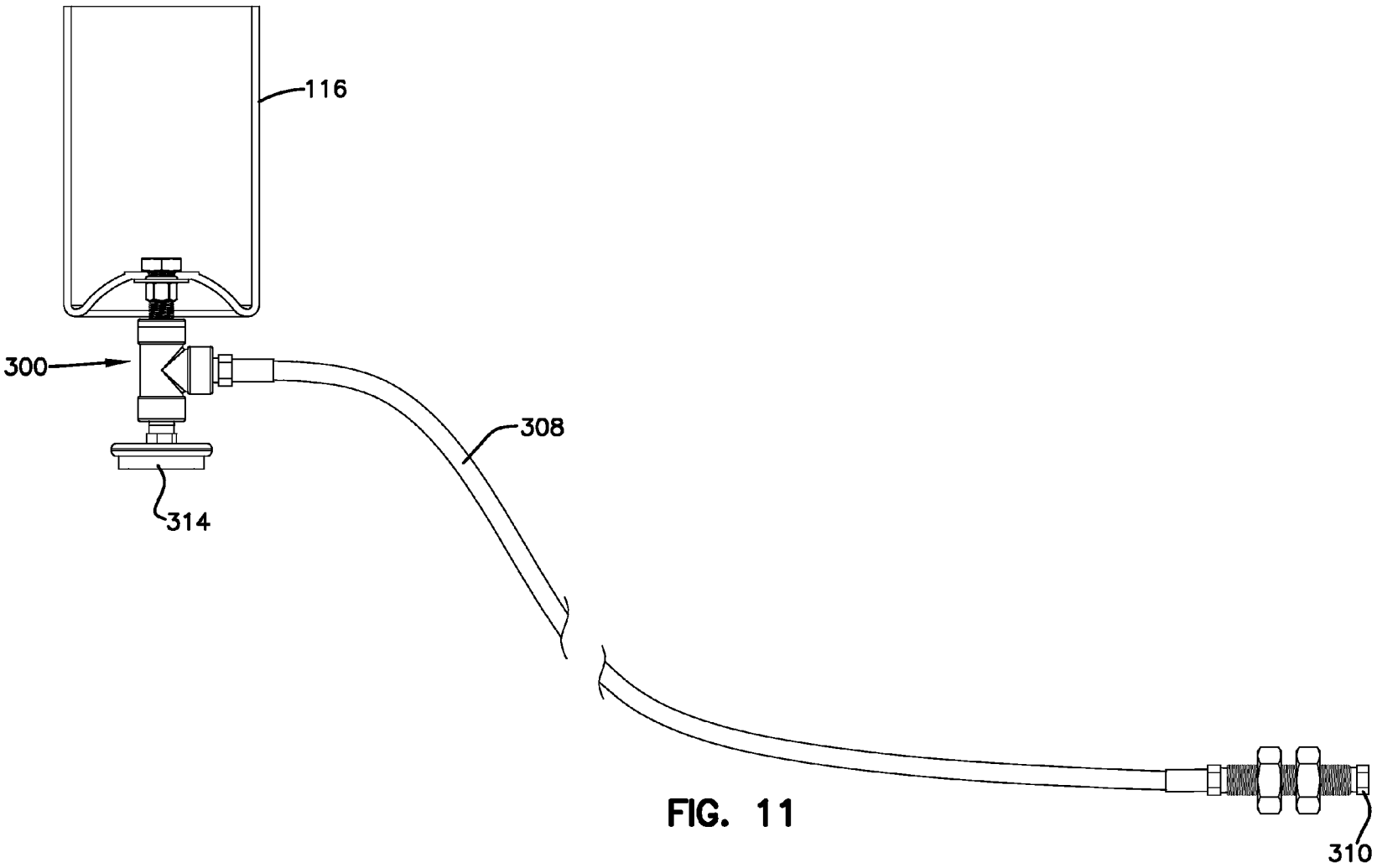
FIG. 11 is a schematic view of another example of the remote automatic head assembly according to the principles of the present disclosure.

FIG. 11 is a schematic view of an example of a different arrangement of the remote automatic head assembly 108. In this example, while the inlet port 302 is connected to the agent container 106 with the connector 306, the gauge 314 can be connected to the port that is opposite to the inlet port 302. The hose 308 is connected to the port that is configured between the inlet port 302 and the port that is engaged with the gauge 314. Alternatively, in FIGS. 9 and 10, the one end of the hose 308 can simply be connected to the gauge port 312 and the gauge 314 can be connected to the outlet port 304.

In another embodiment, the remote automatic head assembly 108 having the fitting pipe 300 according to the present disclosure can be configured to replace a typical pressure gauge that is attached to a fire extinguisher. A pressure gauge that is typically installed to the bottom of an existing fire extinguisher can be removed from the fire extinguisher, and the T-fitting pipe of the remote automatic head assembly 108 can be mounted onto the place from which the pressure gauge has been disassembled. The pressure gauge can, then, be assembled to the gauge port 312 of the remote automatic head assembly 108.

The remote automatic head assembly 108 has a variety of application. For example, the remote automatic head assembly 108 can be used to extinguish a fire that can break out in an engine compartment of vehicles or machinery. Vehicles, such as race cars or commercial vehicles, have a firewall against the engine compartment. While the agent container 106 is installed at a different place, such as under a driver cockpit or a passenger seat, the end of the hose 208 having the temperature responsive element 310 can be installed in a hole, which is arranged on the firewall, with the mounting device 316. As illustrated in FIG. 9, the two nuts of the mounting device 316 are screwed along the threaded portion of the connector and fastened on each side of the firewall. The remote automatic head assembly 108 can also be applied to engine rooms in vehicles or machinery or to commercial kitchens or any room with cooking area.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. An apparatus for discharging a fire-extinguishing agent from a fire extinguisher, the fire extinguisher including an agent container storing the fire-extinguishing agent and a fire extinguisher actuator operatively connected to the agent container, the fire extinguisher actuator including a discharge pipe having an outlet and being configured to selectively discharge the fire-extinguishing agent through the outlet of the discharge pipe, the apparatus comprising:

an automatic head assembly mounted onto the fire-extinguisher, the automatic head assembly comprising:

a housing having an interior space, a forward end, and a discharge pipe opening, the discharge pipe opening being arranged at the forward end of the housing and arranged and configured to align with the discharge pipe of the fire extinguisher actuator when the automatic head assembly is mounted onto the fire extinguisher to permit the fire-extinguishing agent to be discharged from the housing therethrough;

a mounting device configured to mount the housing onto the agent container of the fire extinguisher, wherein when the housing is mounted onto the agent container, the fire extinguisher actuator is at least partially received within the interior space of the housing and the agent container extends out from the housing;

a detection mechanism including:

a supporting mechanism at least partially arranged within the interior space of the housing and including a support portion at least partially extending through the forward end of the housing and exterior of the housing; and a temperature responsive element configured to detect a presence of a fire and arranged and configured to be supported on the support portion exterior of and at the forward end of the housing; and a triggering mechanism at least partially received in the interior space of the housing and operatively connected to the detection mechanism by the supporting mechanism and adapted to operate the actuator to trigger the discharge of the fire-extinguishing agent from the agent container of the fire extinguisher through the outlet of the discharge pipe of the actuator in a spray direction upon the detection of the presence of a fire by the detection mechanism, the spray direction extending from the forward end of the apparatus.

2. The apparatus of claim 1, wherein the temperature responsive element has two pieces and is configured to break apart between the two pieces at a predetermined temperature, and the supporting mechanism is configured to support the two pieces of the temperature responsive element, wherein the triggering mechanism includes an extension element and a lever, the lever pivotally connected to the housing and configured to be engaged with the supporting mechanism at one of the two pieces of the temperature responsive element, wherein the extension element is held in a compressed position when the temperature responsive element is supported by the supporting mechanism, and is extended to permit the lever to pivot with respect to the housing and operate the actuator to be in fluid communication with the agent container to discharge the agent from the agent container when the temperature responsive element breaks apart between the two pieces at the predetermined temperature.

3. The apparatus of claim 2, wherein the housing has a top portion, a bottom portion, and a front portion, the bottom portion configured to be installed to the agent container, the front portion having a longitudinal opening, wherein the lever has a tip portion, a resisting portion, an actuation portion, and a pivot portion, the lever pivotally connected to the housing at the pivot portion, wherein the tip portion of the lever is arranged to protrude from the front portion of the housing through the longitudinal opening of the housing and is movable along the longitudinal opening of the housing, wherein the temperature responsive element includes two apertures, the temperature responsive element capable of breaking apart between the two apertures at or above a predetermined temperature, wherein the supporting mechanism includes a release clip and the tip portion of the lever, the release clip having a first end and a second end, wherein the second end of the release clip is connected to the housing, and the first end of the release clip is arranged and configured to protrude from the front portion of the housing and hold one of the two apertures of the temperature responsive element, wherein the tip portion of the lever is configured to hold the other aperture of the temperature responsive element, wherein the extension element is engaged between the resisting portion of the lever and the top portion of the housing and held in a compressed position when the two apertures of the temperature responsive element are held by the first end of the release clip and the tip portion of the lever, and wherein the extension element is released and extended against the top portion of the housing, pressing on the resisting portion of the lever, and permits the lever to pivot about the pivot portion of the lever with respect to the housing, when the temperature responsive element breaks apart between the two apertures, so that the actuation portion of the lever presses on the actuator to have the actuator in fluid communication with the agent container.

4. The apparatus of claim 3, wherein the actuator of the fire extinguisher includes an inlet pipe, a receptive portion, and a discharging pipe, wherein the discharging pipe is in fluid communication with the inlet pipe to discharge an agent from an agent source of the fire extinguisher, wherein the receptive portion is arranged and configured to be pressed on by the actuation portion of the lever when the lever pivots about the pivot portion with respect to the housing by extension of the extension element, and wherein the inlet pipe is configured to be in fluid communication with the agent source of the fire extinguisher when the receptive portion is pressed on.

5. The apparatus of claim 3, wherein the housing includes a first opening and a second opening, the first opening configured to accommodate the inlet pipe of the actuator in the housing, and the second opening configured to accommodate the discharging pipe of the actuator and permit at least an outlet of the discharging pipe to protrude from the housing.

6. The apparatus of claim 2, further comprising an installation mechanism configured to install the housing to the agent container, the installation mechanism including a collet, the collect configured to be mounted to the fire extinguisher and coupled to the bottom portion of the housing.

7. The apparatus of claim 1, wherein the temperature responsive element is a fusible link.

8. The apparatus of claim 2, wherein the extension element is a compression spring.

9. The apparatus of claim 1, further comprising an agent-flow guide unit, the unit arranged and configured to be connected to the housing adjacent to an outlet of the actuator so as to adjust a flow of the agent discharged from the outlet of the discharging pipe of the actuator.

10. The apparatus of claim 9, wherein the agent-flow guide unit is configured to have a rake shape having a plurality of slits and bend downwardly in front of the outlet of the discharging pipe of the actuator.

11. The apparatus of claim 3, further comprising a manual release device, the manual release device configured to removably connect the supporting mechanism to the housing, wherein, when the manual release device removes the supporting mechanism from the housing, the triggering mechanism operates an actuator to be in fluid communication with the agent container to discharge the agent from the agent container.

12. The apparatus of claim 11, wherein the manual release device includes a clip support and a release pin, wherein the release clip includes a curved portion between the first end and the second end of the clip support, wherein the clip support includes a nest aperture arranged in the top portion of the housing, the nest aperture configured to be aligned to the curved portion of the release clip so that the curved portion of the release clip rests on the top portion of the housing around the nest aperture, and wherein the release pin is removably inserted into the curved portion of the release clip underneath the top portion of the housing to support the second end of the release clip to the housing.

13. A head assembly for a fire-extinguisher, the fire extinguisher including an agent container storing a fire-extinguishing agent and a fire extinguisher actuator operatively connected to the agent container, the fire extinguisher actuator including a discharge pipe having an outlet and being configured to selectively discharge the fire-extinguishing agent through the outlet of the discharge pipe, the head assembly comprising:

a housing having an interior space, a forward end, and a discharge pipe opening, the discharge pipe opening arranged at the forward end of the housing and arranged and configured to align with the discharge pipe of the fire extinguisher actuator when the automatic head assembly is mounted onto the fire extinguisher to permit the fire-extinguishing agent to be discharged from the housing therethrough;

a mounting device configured to mount the housing onto the agent container of the fire extinguisher, wherein when the housing is mounted onto the agent container, the fire extinguisher actuator is at least partially received within the interior space of the housing and the agent container extends out from the housing;

a temperature responsive element arranged at exterior of and at the forward end of the housing and configured to detect the presence of a fire; and a triggering mechanism at least partially received in the interior space of the housing and configured to operate the fire extinguisher actuator to discharge the fire-extinguishing agent from the agent container through the outlet of the discharge pipe of the fire extinguisher actuator in a spray direction upon the detection of the presence of a fire by the temperature response element, the spray direction extending from the forward end of the head assembly.

14. The head assembly of claim 13, further comprising:

an installation mechanism configured to mount the bottom portion of the housing to the agent container to arrange the forward portion of the housing to face in the spray direction.

15. The head assembly of claim 14, wherein the temperature responsive element is arranged outside the housing.

16. The head assembly of claim 14, wherein the triggering mechanism includes a lever pivotally supported by the housing and engaging the temperature responsive element, the lever pivoting to operate the actuator to discharge a fire-extinguishing agent from the agent container when the temperature responsive element detects the presence of a fire.

17. The head assembly of claim 13, wherein the temperature responsive element is configured to break apart to two pieces at a predetermined temperature.

18. The head assembly of claim 17, wherein the triggering mechanism includes a lever and a release pin, the lever pivotally supported by the housing and engaging one of the two pieces of the temperature responsive element, and the release pin moveably supported by the housing to engage the other piece of the temperature responsive element, wherein, upon the detection of presence of a fire, the pieces of the temperature responsive element break apart, allowing the lever to pivot to operate the actuator to discharge a fire-extinguishing agent from the agent container.

19. The head assembly of claim 17, wherein, when the release pin is manually removed from the housing, the lever is allowed to pivot to operate the actuator to discharge a fire-extinguishing agent from the agent container.

20. A fire-extinguisher comprising:

an agent container storing a fire-extinguishing agent;

a fire extinguisher actuator having a discharge conduit, the fire extinguisher actuator being configured to discharge the fire-extinguishing agent from the agent container and through the discharge conduit in a spray direction; and a head assembly mounted onto the fire-extinguisher, the head assembly including:

a housing having an interior space, a forward end aligned with the spray direction, and a discharge pipe opening, the discharge pipe opening arranged at the forward end of the housing and arranged and configured to align with the discharge pipe of the fire extinguisher actuator when the automatic head assembly is mounted onto the fire extinguisher to permit the fire-extinguishing agent to be discharged from the housing therethrough;

a mounting device configured to mount the housing onto the agent container of the fire extinguisher, wherein when the housing is mounted onto the agent container, the fire extinguisher actuator is at least partially received within the interior space of the housing and the agent container extends out from the housing;

a temperature responsive element arranged exterior of and at the forward end of the housing and configured to detect the presence of a fire; and a triggering mechanism at least partially received in the interior space of the housing and configured to operate the fire extinguisher actuator to trigger the discharge of the fire-extinguishing agent through the outlet of the discharge conduit upon the detection of the presence of the fire by the temperature response element.

* * * * *